US006085472A

United States Patent [19]

Malhotra

[11] Patent Number: 6,085,472

[45] Date of Patent: Jul. 11, 2000

[54] METHOD OF PROTECTING LIQUID STORAGE TANKS FROM SEISMIC SHOCKS AND AN ANCHOR ESPECIALLY ADAPTED FOR THE SAME

[76] Inventor: Praveen K. Malhotra, 4941 Knightswood Way, Granite Bay, Calif. 95746

[21] Appl. No.: 09/130,587

[22] Filed: Aug. 7, 1998

[51] Int. Cl.[7] ..... E04H 9/02

[52] U.S. Cl. ..... 52/167.4; 52/167.1; 52/167.7; 248/188.1

[58] Field of Search ..... 52/1, 167.1, 167.4, 52/167.7, 167.8; 248/188.1, 677

[56] References Cited

U.S. PATENT DOCUMENTS 3,990,600 11/1976 Rossitto et al. ..... 220/5

OTHER PUBLICATIONS

*Seismic Strengthening of Liquid–Storage Tanks with Energy–Dissipating Anchors* by Praveen K. Malhotra (1998), J. of Structural Eng., Apr., 1998, pp. 405 et seq.

*Seismic Isolation of Storage Tanks* by Kelly et al. (1986); Proc. of Structures Congress 1989, pp. 408 et seq.

*Application of Seismic Isolation to Industrial Tanks* by Victor A. Zayas and Stanley S. Low, 1995 ASME/JSME Pressure Vessels and Piping Conference.

*Seismic Isolation of Critical Components and Tanks* by Frederick F. Tajirian (1995), Proc. ATC–17–1 Seminar on Seismic Isolation, Passive Energy Dissipation and Active Control, vol. 1, 233–244.

*Primary Examiner*—Carl D. Friedman
*Assistant Examiner*—Pat J. Chavez
*Attorney, Agent, or Firm*—C. Michael Zimmerman

[57] ABSTRACT

A method of protecting liquid storage tanks from earthquakes and an anchor especially adapted to carry out this method are described. The method includes providing an energy dissipating anchor between the liquid tank and structure which will move with the ground. The anchor includes a stainless steel shaft which is secured to a ring foundation. This shaft is surrounded by a clamp which frictionally grips the same and is secured to the tank.

6 Claims, 3 Drawing Sheets

37
38
34
13
17
16
14

21
19
29
31
31
26
18
24
22
24
12

18
22
19
32
31
33
29
28
41
13
16

21
19
3B
29
31
31
36
34
13
16
3B
22
26
24
18
24
14
17
12

METHOD OF PROTECTING LIQUID STORAGE TANKS FROM SEISMIC SHOCKS AND AN ANCHOR ESPECIALLY ADAPTED FOR THE SAME

BACKGROUND OF THE INVENTION

This invention relates to a method of protecting ground-supported, liquid storage metal tanks from potentially damaging earthquake ground shaking. It also includes an energy-dissipating seismic anchor especially designed to limit the transfer of seismic energy into a liquid storage tank and hence reduce the forces experienced by the tank.

Ground-supported cylindrical tanks are used to store a variety of liquids, e.g., water for drinking and fire-fighting, crude oil, wine and liquefied natural gas (LNG). Tanks are critical components of modern industrial facilities and life-line systems, and must be designed to withstand safely the earthquakes to which they are subjected. The failure of such systems may lead to environmental hazard, loss of valuable contents, and disruption of fire-fighting efforts following destructive earthquakes.

Ground-supported liquid-storage metal tanks are designed to be either fully (rigidly) anchored or unanchored at their base (API, "Welded Steel Tanks for Oil Storage," API Standard 650, 9th Ed., American Petroleum Institute, Washington, D.C., 1993; AWWA, "Welded Steel Tanks for Water Storage," AWWA D100, American Water Works Association, Denver, Colo., 1996). When subjected to severe earthquake ground shaking, fully anchored tanks develop large base shear and overturning moment due to hydrodynamic action and impose high demands on their base anchorage system and foundation. High stresses in the vicinity of poorly detailed anchors can tear the tank wall, and large base shear can overcome friction between the base and the foundation, causing the tank to slide.

When subjected to ground shaking stronger than design, a traditionally anchored tank experiences inelastic stretching or pulling of the anchor bolts. The energy loss due to the inelastic action of the anchor bolts is, however, quite small because the bolts act in tension only—they do not exhibit a cyclic load path capable of dissipating energy in each vibration cycle. Anchor bolts that are not detailed properly can suddenly break or slip leading to a sharp increase in base uplift and associated responses, such as plastic rotations in the base plate, radial separation between the base plate and the foundation, and hoop stress in the tank wall.

Tanks that are unanchored at their base experience partial base uplifting when subjected to strong ground shaking. Increased flexibility associated with base uplifting reduces the hydrodynamic pressures, hence the base shear and overturning moment. However, due to reduced contact of the wall with the foundation, the axial compressive stress increases—leading in severe cases to buckling of the wall.

Unanchored tanks supported directly on flexible soils experience smaller axial compressive stress and are, therefore, less prone to buckling damage as compared to unanchored tanks supported on concrete foundations. However, such tanks can undergo large base uplift, foundation penetration, plastic rotation at plate boundary, hoop compressive stress in the wall, and radial separation between the plate and foundation. Large uplifts can damage the piping connections to the wall, and large foundation penetrations can cause uneven and permanent settlement of the wall due to nonlinear soil response. Several cycles of large plastic rotations can rupture the plate-shell junction leading to a loss of tank's content.

Unsatisfactory performance of both anchored and unanchored tanks when subjected to truly strong ground shaking stems directly from their inability to dissipate large amount of seismic energy. Methods of seismic strengthening of tanks have been proposed in U.S. Pat. No. 3,977,140 to Matsudaira et al., U.S. Pat. No. 4,249,352 and U.S. Pat. No. 4,267,676 to Marchaj and U.S. Pat. No. 4,697,395 to Peek. However, these methods do not increase the energy-dissipation capacity of cylindrical metal tanks.

Methods of base isolation have also been proposed to improve the seismic performance of tanks. Kelly, T. E., and Mayes, R. L. (1989), "Seismic isolation of storage tanks," *Proc., Sessions Related to seismic Engrg. at Structures Congress* '89; C. A. Kircher and A. K. Chopra, eds., ASCE, New York, N.Y., p.p. 408–417; Taijirian, F. E. (1993), "Seismic isolation of critical components and tanks," *Proc., ATC*-17-1 *Seminar on Seismic Isolation, Passive Energy Dissipation, and Active Control.* San Francisco, Calif., Vol. 1, 233–244. In these methods, the tank is supported on a large concrete mat, which, in turn, is supported on several isolation bearings. Although suitable for tanks for which a concrete mat supported above the ground already exists, these methods of isolation are unsuitable for numerous other tanks that are supported directly on the ground.

BRIEF SUMMARY OF THE INVENTION

The present invention provides a method of improving the seismic performance of tanks by dissipating energy that otherwise would be imparted to the same by potentially damaging ground motion.

The method includes, from the broad standpoint, fixing the liquid storage tank with an energy dissipating anchor to a structure which will move with the ground. This anchor can be of a viscous type, a friction type or steel hysteretic type, as for example a damper of the type described in my paper "Seismic Strengthening of Liquid Storage Tanks with Energy-Dissipating Anchors" starting on page 405 of the April, 1998 issue of the Journal of Structural Engineering, ASCE. Most desirably the base of the tank is supported on a flexible soil bed and the tank is fixed around its full periphery by energy dissipating anchors which are rigidly adhered between the tank and a structure which will move with the ground. During strong ground shaking, the wall of the tank uplifts on one side and penetrates this flexible soil bed on the opposite side. The vertical movement of the tank wall causes dissipation of seismic energy in the energy-dissipating anchors.

This invention also provides a practical and inexpensive anchoring device. This anchor includes an energy dissipating coupling connected between the bracket and the base. Most desirably, the coupling relies on friction to provide the energy dissipation. To this end it desirably includes a shaft or pipe defining a slide on which a friction clamp provided in the preferred embodiment by a pair of clamp halves, grips the same by a force selected to provide a desired amount of resistance to movement. The amount of friction by which the slide resists movement of the clamps can be controlled by, for example, coating the surfaces of the clamps which engage the slide with a layer of frictional material.

For weak ground shaking, the friction does not allow the clamp to slide along the shaft, hence the system behaves as a fully (rigidly) anchored system. In contrast, for strong ground shaking, the friction is selected to be not sufficient to prevent the clamp sliding along the shaft. In such a situation, loss of seismic energy takes place by friction generated between the shaft and the sliding clamp. The level of ground shaking below which the system behaves as a fully (rigidly) anchored system is determined by the bolt tension pressing the clamps against the shaft.

Other features and advantages of the invention either will become apparent or will be described in connection with the following, more detailed description of a preferred embodiment of the invention and variations.

BRIEF DESCRIPTION OF THE DRAWING

With reference to the accompanying sheets of drawing.

DETAILED DESCRIPTION OF THE INVENTION

The following, relatively detailed description is provided to satisfy the patent statutes. It will be appreciated by those skilled in the art, though, that various changes and modifications can be made without departing from the invention.

Figure 1:
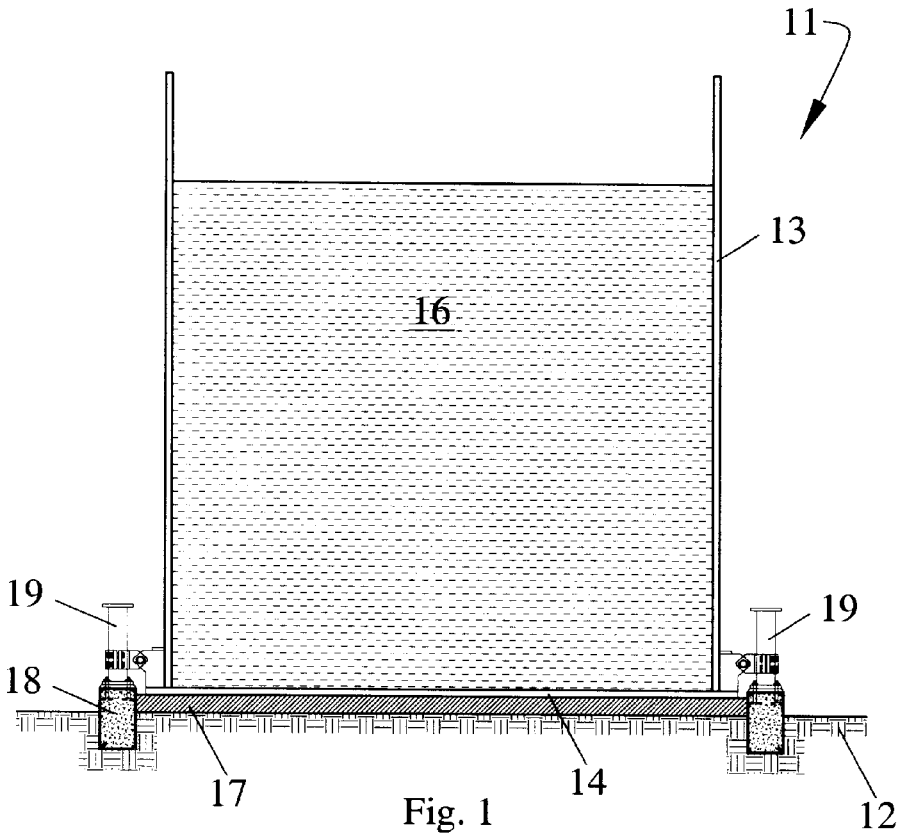
FIG. 1 is a vertical section through a liquid storage metal tank anchored by a preferred embodiment of the invention.
Figure 2:
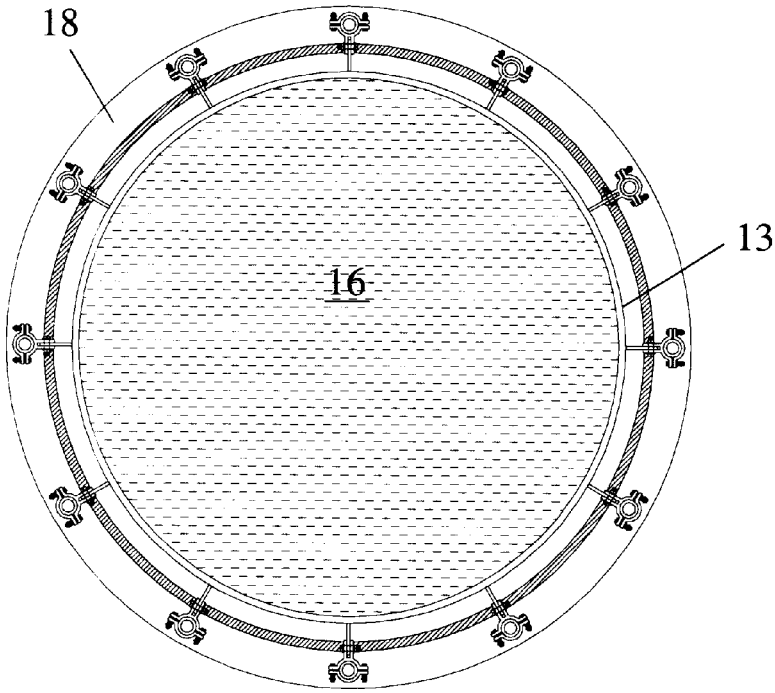
FIG. 2 is a horizontal section through the tank of FIG. 1 showing an arrangement of a plurality of energy-dissipating anchors of a preferred embodiment of the invention.

With reference first to FIGS. 1 and 2, a liquid storage metal tank, generally indicated by the reference numeral 11, is illustrated with a preferred embodiment of the invention acting as an intermediary between it and the ground referred to at 12. The storage tank includes a cylindrical side wall 13 and a bottom plate 14, and holds a liquid, e.g., water 16.

Neither the tank bottom nor its walls are supported by a firm foundation as is often found. Rather, in keeping with the invention, a soil bed 17 is provided underneath the tank to react resiliently. A firm structure 18, though, in the form of a ring foundation, is provided surrounding the tank to move with the ground and act as means for interacting with the preferred embodiment as a coupling for the invention. The ring foundation providing the structure is simply a foundation of a type used often in the past to support a cylindrical wall of a storage tank. In this connection, it is unbroken and is embedded within the ground as is illustrated. In this invention it acts as a firm structure which moves with the ground when the ground moves (shakes) during an earthquake or in reaction to other forces. (It is not necessary that the movement be a "mirror" of the actual ground movement. For example, if a liquid tank is mounted with the invention in or on top of a building with the building providing the structure the building [structure] will move indirectly with the ground, rather than directly with the same.)

Details of the anchor of the invention can be understood from enlarged views, FIG. 3A–FIG. 5. It includes a slide 19 provided by a stainless steel shaft (or pipe) having a stopper plate 21 at its top end and a base plate 22 at its lower end. Both the stopper plate 21 and base plate 22 simply can be welded to the slide 19.

Base plate 22 is carefully leveled with the help of leveling nuts (unnumbered) on partially embedded anchor bolts 24. The gap between such base plat e and the ring foundation 18 is then filled with a non-shrink grout as illustrated at 26.

Figures 3A, 3B, 4, 5:
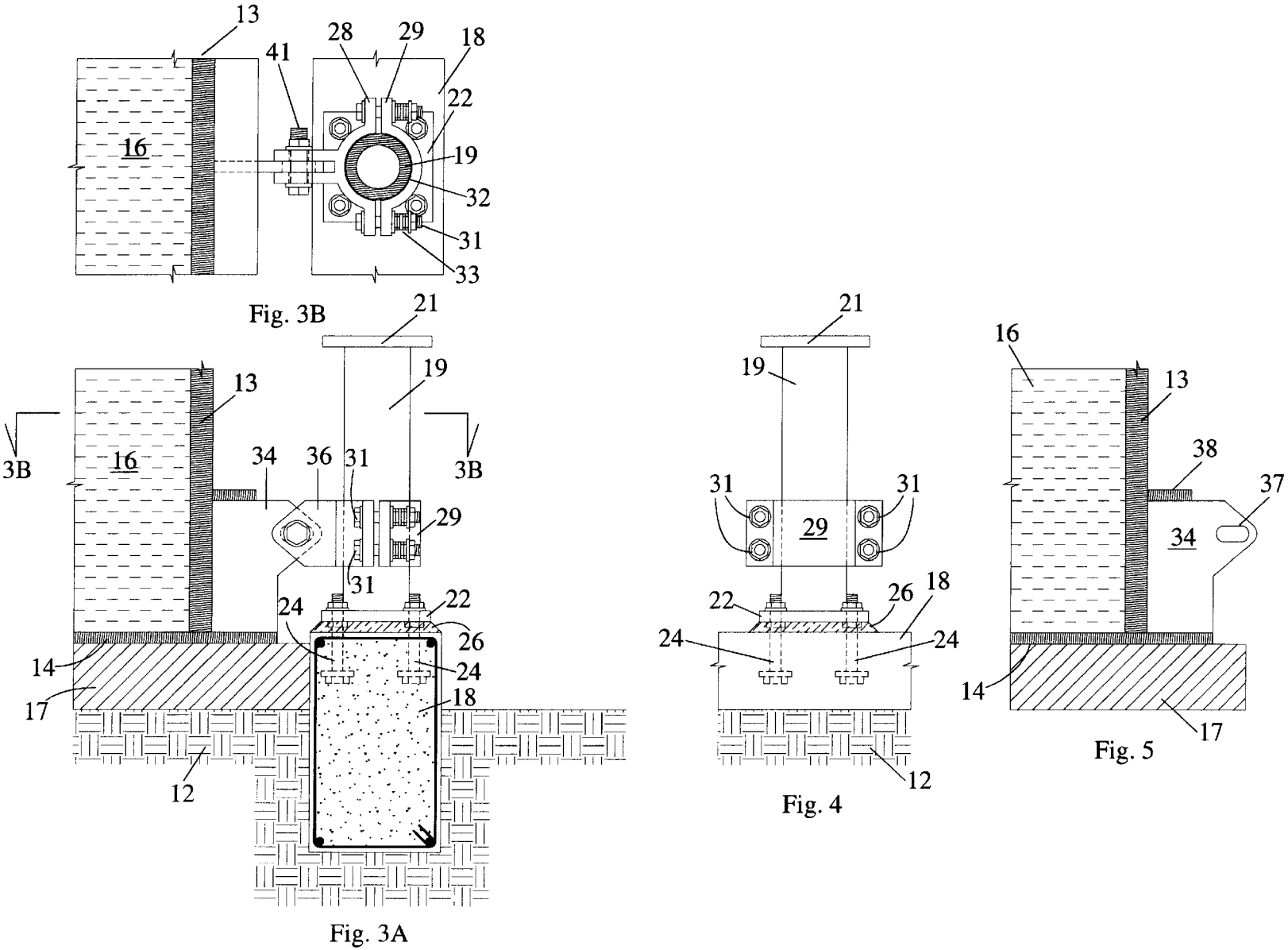
FIG. 3A is an enlarged side elevation view of a preferred anchor of the invention.
FIG. 3B is a sectional view taken on a plane indicated by the lines 3B in FIG. 3A.
FIG. 4 is an end elevation view of the anchor of FIGS. 3A and 3B.
FIG. 5 is a partial and broken away side elevation view showing aspects of a bracket of the preferred embodiment of the anchor of the invention.

As mentioned previously, the clamp of the anchor of the invention is made up of two halves 28 and 29 which are secured together by high strength steel bolts 31. Most desirably the inner surface of these two clamp halves which engage the surface of the slide are coated with a frictional interface layer 32 (FIG. 3B). This layer should possess certain characteristics: (1) It should not degrade under the heat generated by friction; (2) It should possess a fairly constant value of the coefficient of friction, preferably between 0.2 and 0.4; (3) it should not adhere to the slide 19 as a result of several years of no movement between the slide and the clamp halves. Some composites of polytetrafluoroethane (PTFE) are suitable for this application. The actual tension provided by the bolts is controlled by monitoring the compression in spring washers 33 (FIG. 3B) when the bolts are tightened. Selecting the tension also selects the amount of friction between the clamp and the slide. Thus, the amount of friction is initially adjusted to provide a desired demarcation between the anchor(s) in a particular arrangement providing a rigid anchoring system and an energy dissipating one.

The tank is secured to the anchor via a bracket arrangement as illustrated, for example, in FIG. 3A. The bracket is actually made up of a pair of bracket pieces 34 and 36. These bracket pieces are designed to transmit any vertical shear force while allowing restricted horizontal shear force. Moreover, they are designed to allow limited angular movement caused by slight tilting of the tank wall. This is simply accomplished by providing a slotted hole 37 in bracket piece 34, which bracket piece is adhered by welding or the like to the tank between an extension of its bottom plate and an angular flange 38. The configuration of the registering hole in bracket piece 36 is circular, and it will be appreciated by those skilled in the art that the two bracket pieces when secured together via a bolt 41 (FIG. 3B) can move relative to one another to accommodate restricted horizontal relative movement and limited angular movement.

Figure 6:
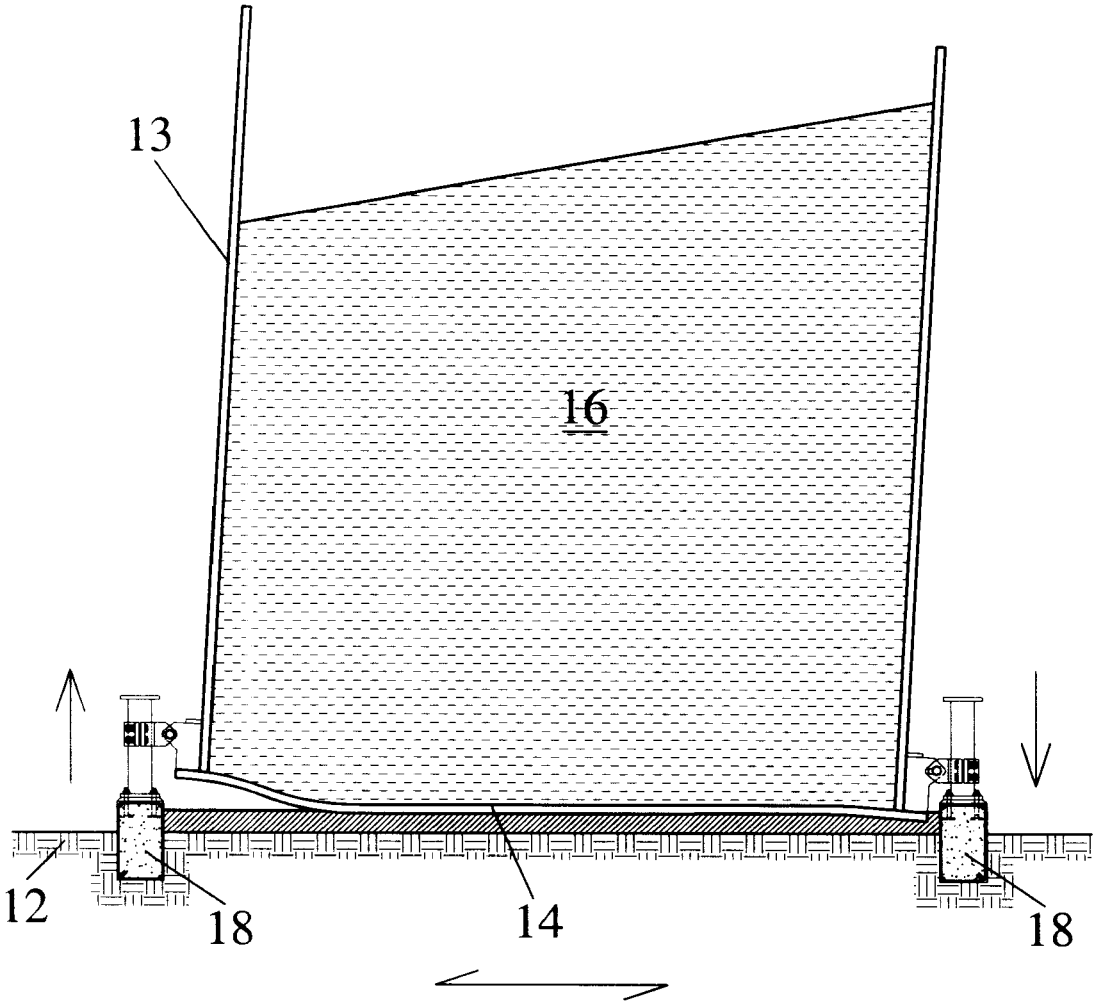
FIG. 6 is a vertical sectional view similar to that of FIG. 1 showing the operation of the invention and the reaction of a liquid storage tank to severe seismic ground shaking.

When subjected to severe earthquake ground shaking, the wall of the tank uplifts on one side and penetrates a flexible soil bed on the opposite side (FIG. 6). Seismic energy is dissipated by resisted, relative movement. That is, it is dissipated by friction generated between the stainless steel shaft and the sliding clamps. Tanks anchored thus are also prevented from displacing horizontally from their foundations. (In those situations in which the tank is small, one may wish to use a flexible sheet rather than the soil bed.)

It will be recognized by those skilled in the art that various changes and modifications can be made without departing from the spirit of the invention. For example, although in the preferred embodiment the slide is provided by a stainless steel shaft and a clamp actually surrounds it, it will be recognized that any structure providing frictional movement between two surfaces will suffice. Thus the "clamp" can fit inside or within a groove in the "slide" as is often found. Moreover, the anchor can be used with objects besides liquid tanks. The terminology "clamp" and "slide" is meant to encompass these geometric variations. The protection provided to the applicant is defined by the claims, their equivalents and their equivalent language.

What is claimed is:

1. An anchor for protecting a ground-supported, liquid storage tank made from a rigid material, from potentially damaging ground motion comprising:

a) a bracket to be rigidly adhered to the tank to move therewith;

b) a base to be rigidly adhered to a structure which will move with the ground; and c) an energy dissipating coupling connected between said bracket and said base; said energy dissipating coupling including a slide held by one of said bracket and base, and a friction coupling held by the other of said bracket and base, which friction coupling is movable upon said slide to cooperate therewith in the absorption of energy imparted to said base or bracket.

2. The anchor of claim 1 for protecting a ground-supported, liquid storage metal tank wherein said friction coupling is adjustable to change the amount of friction by which it engages said slide and therefore change the amount of energy dissipated by the anchor in movement of said coupling on said slide.

3. An anchor for protecting a ground-supported object from potentially damaging ground motion comprising:

a) a bracket to be rigidly adhered to said object;

b) a base to be rigidly adhered to a structure which will move with the ground;

c) a slide held by one of said bracket and base; and d) a friction moveable clamp held by the other of said bracket and base, and clamped on said slide to cooperate therewith in the absorption of energy imparted to said base or bracket.

4. The anchor of claim 3 for protecting a ground-supported object wherein said clamp is defined by a pair of clamp helps which are configured to surround a surface of said slide and be secured to one another.

5. The anchor of claim 4 for protecting a ground-supported object from potentially damaging ground motion wherein the grip provided by said clamp on said slide is adjustable to change the resistance of said clamp to movement on said slide and therefore change the amount of energy absorbed by movement of said clamp on said slide.

6. The anchor of claim 4 for protecting a ground-supported object from potentially damaging ground motion wherein said bracket includes a pair of cooperating bracket pieces, one of which is rigidly adhered to said side wall of said tank and the other of which is pivotally mounted to the first one to accommodate angular motion.

* * * * *